US005526787A

United States Patent [19]

Pallett

[11] Patent Number: 5,526,787

[45] Date of Patent: Jun. 18, 1996

[54] ELECTRONIC THROTTLE CONTROL SYSTEM INCLUDING MECHANISM FOR DETERMINING DESIRED THROTTLE POSITION

[75] Inventor: Tobias J. Pallett, Ypsilanti, Mich.

[73] Assignee: Ford Motor Company, Dearborn, Mich.

[21] Appl. No.: 436,677

[22] Filed: May 8, 1995

[51] Int. Cl.[6] ..... F02D 9/10; F02D 11/10

[52] U.S. Cl. ..... 123/399

[58] Field of Search ..... 123/352, 361, 123/399, 478, 488

[56] References Cited

U.S. PATENT DOCUMENTS

| | | | |
|---|---|---|---|
| 4,549,517 | 10/1985 | Kamiyama | 123/399 X |
| 4,763,264 | 8/1988 | Okuno et al. | 123/399 X |
| 4,799,467 | 1/1989 | Ishikawa et al. | 123/399 |
| 4,881,502 | 11/1989 | Kabasin | 123/399 |
| 5,349,932 | 9/1994 | Boverie et al. | 123/399 |
| 5,406,920 | 4/1995 | Murata et al. | 123/399 |

*Primary Examiner*—Tony M. Argenbright
*Attorney, Agent, or Firm*—Allan J. Lippa; Roger L. May

[57] ABSTRACT

A closed-loop controller implemented by an engine control microprocessor for adjusting the position of the intake throttle of an engine. Sensors, typically shared with other engine control mechanisms, develop electrical signal values indicating intake air pressure and temperature as well as the pressure within the intake manifold. A programmed microcontroller responsive to these signal values, and to a value indicating a desired rate of air flow into the engine, produces a further value representing a desired throttle position. A comparator is used to produce an error signal indicating the extent to which the measured actual air flow rate value deviates from the desired flow rate value. Finally, a closed-loop feedback control mechanism jointly responsive to this error signal and to the desired throttle position value operates a mechanism which controls the throttle position, thereby maintaining a close correspondence between the actual and desired air flow rates.

3 Claims, 1 Drawing Sheet

ELECTRONIC THROTTLE CONTROL SYSTEM INCLUDING MECHANISM FOR DETERMINING DESIRED THROTTLE POSITION

FIELD OF THE INVENTION

This invention relates to electronic engine control systems and more particularly to a system for controlling the position of a throttle valve in an internal combustion engine to achieve a desired air flow rate into the engine's intake manifold.

SUMMARY OF THE INVENTION

The present invention takes the form of an electronic control system for controlling the intake throttle of an engine. The system employs sensing means, typically shared with other engine control mechanisms, for developing electrical signal values indicating intake air pressure and temperature as well as the pressure within the intake manifold. Processing means responsive to these signal values, and to a value indicating a desired rate of air flow into the engine, produce a further value representing a desired throttle position. A comparator is used to produce an error signal indicating the extent to which the measured actual air flow rate value deviates from the desired flow rate value. Finally, a closed-loop feedback control mechanism jointly responsive to this error signal and to the desired throttle position value operates a mechanism which controls the throttle position, thereby maintaining a close correspondence between the actual and desired air flow rates.

These and other features of the invention may be more completely understood by considering the following detailed description of a preferred embodiment of the invention. In the course of this description, reference will frequently be made to the attached drawing.

DESCRIPTION OF THE PREFERRED EMBODIMENT

Figure 1:
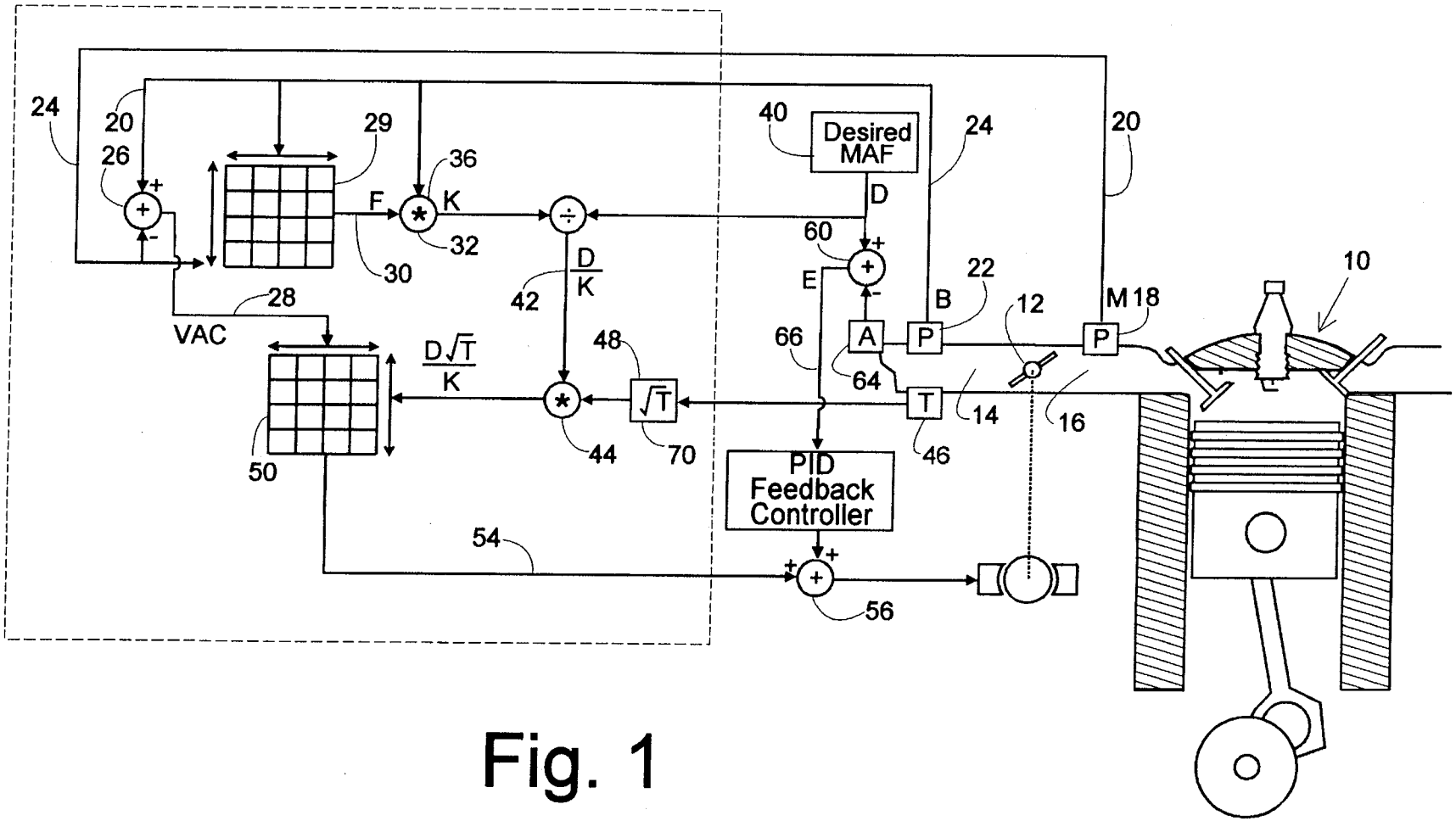
FIG. 1 is a block schematic diagram of an electronic throttle control system which embodies the invention.

The description which follows will begin with a general discussion of the embodiment shown in FIG. 1, followed by a more detailed description of the theory which underlies the signal processing steps employed.

As seen in FIG. 1, an internal combustion engine illustrated by the single cylinder indicated generally at 10 includes a throttle valve 12 positioned between an air intake 14 and an intake manifold 16. A sensor 18 produces an output signal quantity M on line 20 which indicates the pressure within the intake manifold 16. Similarly, a sensor 22 produces an output signal quantity B on line 24 which indicates the barometric pressure at the air intake 14. As will be understood by those skilled in the art, the airflow and pressure values may be indirectly measured or inferred based on other measured values, particularly engine speed. A comparator 26 having its inputs connected to lines 20 and 24 produces an output signal quantity VAC on line 28 representing the pressure drop across the throttle 12.

The quantities B and M are also used as index values to identify a particular predetermined value F in a two-dimensional lookup table 29. Each of stored values of F in table 29 have a predetermined functional relationship to the ratio between the intake barometric pressure indicated by the quantity B and the manifold pressure indicated by the quantity M. The lookup value F from table 29 is supplied via line 30 to one input of a multiplier 32, the second input of which receives the quantity B via line 24.

Multiplier 32 produces an output quantity K=F*B on line 34 which is delivered to one input of a divider 36. The second input to divider 36 is connected to receive a quantity D from an external source 40. The source 40 typically produces the desired air flow rate quantity D based on the vehicle's accelerator position set by the driver, and/or on values produced by cruise control, anti-skid, or other mechanisms.

The divider 39 delivers a quotient value (D/K) over line 42 to one input of a second multiplier 44. The second input of multiplier 44 is connected to receive a value indicative of the square root of the intake air temperature produced the combination of a temperature sensor 46 and a square-root circuit 48 which indicates the desired rate of air flow to the engine.

The output from multiplier 44 is a supplied as a first indexing input to a second two-dimensional lookup table 50, the second indexing input being the quantity VAC supplied via line 28 from the comparator 26. As discussed in more detail later, the first indexing input value, (D*Sqrt(T))/K, is indicative of the desired effective throttle valve area for a particular desired flow rate D, a given intake air temperature T, and a given relationship between the barometric and manifold pressures B and M. The lookup table 50 stores values which indicate the desired throttle angle Θ given a particular effective throttle area (from multiplier 44) and a given pressure drop value VAC from comparator 26. Table 50 delivers the resulting desired throttle angle value Θ via line 54 to a comparator 56.

A comparator 60 is connected to an airmeter 64 which senses the actual instantaneous air flow rate into the engine. Comparator 40 subtracts this actual rate value from the desired rate quantity D from source 40 to produce an instantaneous flow rate error value E on line 66. The instantaneous error quantity E is then processed by a conventional proportional-integral-differential or "PID" feedback controller 70 which generates an error feedback: the first being proportional to the instantaneous error value E, the second being related to the integral (weighted average) of the instantaneous value, and the third being related to the derivative (rate of change) of the instantaneous value. While a PID controller of the type indicated at 70 could be used by itself to directly control throttle position based on the instantaneous error signal E, substantially improved performance is achieved by allowing the controller to work in combination with the mechanism contemplated by the invention for separately producing the desired throttle angle Θ. The inclusion of this added mechanism allows the controller 70 to be tuned mainly for improved transient response and steady state noise rejection, since the production of a desired throttle angle frees the controller from the need to provide the steady state component of the output control signal.

The control mechanism shown in FIG. 1 is preferably implemented, to the extent possible, using the same processor that provides other engine control functions, such as fuel delivery rate control. The processing required to implement the disclosed comparisons, divisions, multiplications and table-lookup operations may be readily accomplished by suitably programming the existing engine control microprocessor and by storing the information forming the lookup tables 29 and 50 in available read-only memory.

THROTTLE FLOW MODEL

The theoretical foundation for the present invention is found in known mathematical models which describe the effect of a throttle plate on the flow of air into the manifold plenum. The air flow rate is a known function of the manifold pressure $P_{man}$, the air temperature at the inlet $T_{in}$, and the atmospheric pressure $P_a$. Theoretical analysis of the flow of an ideal gas under steady, one dimensional, frictionless, compressible, adiabatic flow yields the following expression for the mass flow rate through the throttle body:

$$\frac{dM_a}{dt} = C_d A_{th} P_a \sqrt{\frac{1}{R * T_{inlet}}}\ \Phi \tag{1}$$

where, for non-choked flow:

$$\Phi = \sqrt{\frac{2\gamma}{\gamma-1}}\ \sqrt{\left(\frac{P_m}{P_a}\right)^{\frac{2}{\gamma}} - \left(\frac{P_m}{P_a}\right)^{\frac{\gamma+1}{\gamma}}} \quad \text{for} \quad \frac{P_m}{P_a} > \left(\frac{2}{\gamma+1}\right)^{\frac{\gamma}{\gamma-1}} \tag{2}$$

and where, for choked flow:

$$\Phi = \sqrt{\gamma}\left(\frac{2}{\gamma+1}\right)^{\frac{\gamma+1}{2(\gamma-1)}} \quad \text{for} \quad \frac{P_m}{P_a} \leqq \left(\frac{2}{\gamma+1}\right)^{\frac{\gamma}{\gamma-1}} \tag{3}$$

In the foregoing expressions, R is the specific gas constant and $\gamma$ is the ratio of specific heats and is equal to approximately 1.4 for an air charge. The product of $C_d$ and $A_{th}$ makes up the effective flow area with $C_d$ being a discharge coefficient typically determined by a regressed equation of several flow and geometric parameters, and with $A_{th}$ being the geometric flow area of the throttle. The theoretical basis for these relationships, and as well as related methods of modeling the flow rate through physical throttle systems, is described in more detail in published literature, including "Internal Combustion Engine Fundamentals" by J. B. Heywood (McGraw Hill, 1988); "Simulation of the Breathing Processes and Air-Fuel Distribution Characteristics of Three-Valve, Stratified Charge Engines" by J. M. Novak, SAE 770881 ( Society of Automotive Engineers, September, 1977); and "Analysis and Digital Simulation of Carburetor Metering" by D. L Harrington and J. A. Bolt, SAE Paper 700082, SAE Transactions, Vol. 79 (1970).

If the mass flow rate given by equation 1 is measured in 1 bm/minute, the throttle area $A_{st}$ in square inches, Pa in inches-Hg, and $T_{inlet}$ in degrees C., equation (1) can be reduced through the use of a units conversion factor CF to:

$$\frac{dM_a}{dt} = \frac{C_d A_{th} P_a \Phi}{\sqrt{T_{inlet}}} * CF \tag{4}$$

where $$CF = 22.87891298\ \frac{\text{lbm} * \sqrt{°\text{K.}}}{\text{inches}^2 * \text{inches-}Hg * min} \tag{5}$$

The quantity $\Phi$ described in equation 3 may multiplied by $P_a$ and by CF to form a quantity K where CF*$\Phi$ is determined as a function f of the pressure ratio ($P_a/P_m$), where the values of the function f are stored in the lookup table 29 shown in FIG. 1. Accordingly, the value K may be expressed as follows:

$$K = CF * P_a * f\left(\frac{P_a}{P_m}\right) \tag{6}$$

From equation 4, it may be seen that the product of $C_d$ and $A_{th}$, which expresses the effective flow area of the throttle, is then given by the relation:

$$C_d A_{th} = \frac{MAF_{desired} * \sqrt{T_{inlet}}}{K} \tag{7}$$

This effective flow area value may then be used, along with a value indicating the pressure drop across the throttle valve, to access a set of corresponding throttle position values stored in the lookup table 50, each stored position value specifying the throttle angle needed to provide the indicated effective flow area at a given pressure drop across a given physical throttle geometry.

It is to be understood that the specific embodiment of the invention which has been described is merely illustrative of the principles of the invention. Numerous modifications to this exemplary embodiment may be made without departing from the true spirit and scope of the invention.

What is claimed is:

1. An electronic system for controlling the position of a throttle valve employed to control the flow of intake air from an air intake into the intake manifold of an internal combustion engine, said system comprising, in combination, means for producing a first signal having a value indicative of the air pressure at said air intake, means for producing a second signal having a value indicative of the air pressure within said intake manifold, means for producing a third signal having a value indicative of the temperature of the air flowing into said air intake, means for producing a fourth signal having a value indicative of a desired rate of air flow, processing means responsive to said first, second, third and fourth signals for producing a fifth signal having a value indicative of a desired throttle position based on the currently sensed intake air pressure, manifold pressure, intake air temperature, and desired rate of air flow, means for producing a sixth signal indicative of the actual rate of air flow into said air intake, feedback controller means responsive said fourth and said sixth signals for producing an error signal indicative of the extent to which said actual and said desired rate of air flow differ, and positioning means jointly responsive to said error signal and to said fifth signal for adjusting the position of said throttle valve such that said actual rate of air flow more nearly matches said desired rate of air flow.

2. An electronic system as set forth in claim 1 wherein said processing means comprises, in combination, means for storing a plurality of predetermined throttle position values in a lookup table, each of said lookup values being designated by first and second index variables, means responsive to said first and said second signals for supplying a vacuum level value for use as said first index variable, means responsive to said first, second, third and fourth values for producing said second index variable, and means responsive to said first and said second index variables for selecting one of said predetermined throttle position values as said fifth signal supplied to said positioning means.

3. An electronic system as set forth in claim 2 wherein said means for producing said second index variable comprises means for generating, as said second index variable, a quantity proportional to a quotient of (1) the product of said value indicating said desired rate of flow times the square root of said value indicative of said temperature, divided by (2) the product of said value indicative of the air pressure at said air intake times a value functionally related to the ratio of the values indicative of the pressures at said air intake and in said manifold.

* * * * *